United States Patent [19]

Sierra

[11] Patent Number: 4,631,942

[45] Date of Patent: Dec. 30, 1986

[54] LOCK STRUCTURES

[76] Inventor: Rafael Sierra, 639 Alamitos Ave., Long Beach, Calif. 90802

[21] Appl. No.: 770,780

[22] Filed: Aug. 29, 1985

Related U.S. Application Data

[63] Continuation-in-part of Ser. No. 543,690, Oct. 20, 1983, Pat. No. 4,590,777.

[51] Int. Cl.[4] ..... E05B 27/04

[52] U.S. Cl. ..... 70/368; 70/371; 70/375; 70/421

[58] Field of Search ..... 70/368, 375, 369, 371, 70/421, 364 A

[56] References Cited

U.S. PATENT DOCUMENTS

| | | | |
|---|---|---|---|
| 1,685,022 | 9/1928 | Cleaver | 70/364 A |
| 2,049,548 | 8/1936 | Swanson | 70/421 |
| 4,094,175 | 6/1978 | Pechner | 70/364 A |

FOREIGN PATENT DOCUMENTS

| | | | |
|---|---|---|---|
| 1131553 | 2/1957 | France | 70/421 |
| 2280772 | 2/1976 | France | 70/421 |
| 252097 | 9/1948 | Switzerland | 70/364 A |

*Primary Examiner*—Alexander Grosz
*Assistant Examiner*—Lloyd A. Gall
*Attorney, Agent, or Firm*—Grover A. Frater

[57] ABSTRACT

A piston type lock employs stepped diameter pistons or pins and bores to prevent fallout of pins on disassembly and also multilevel surfaces at the lock rotor and housing interface such that one or more of the pins serve to retain the rotor in the housing in the unlocked condition of the lock.

1 Claim, 9 Drawing Figures

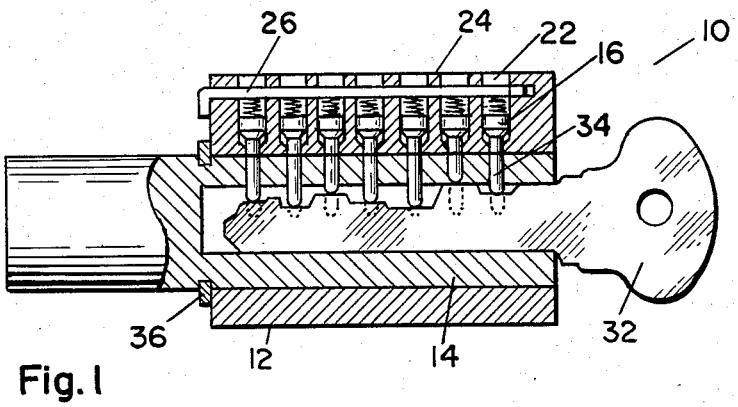
Fig. 1
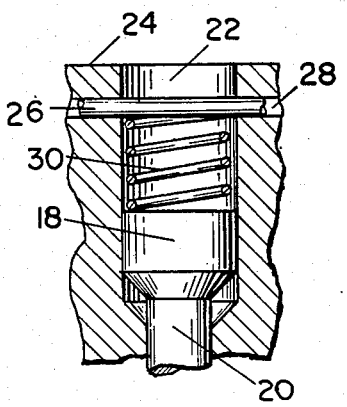
Fig. 2
Fig. 3
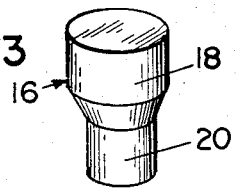
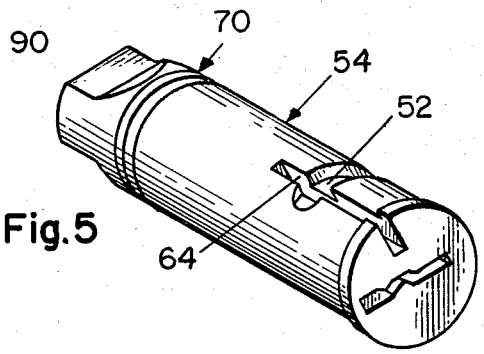
Fig. 5
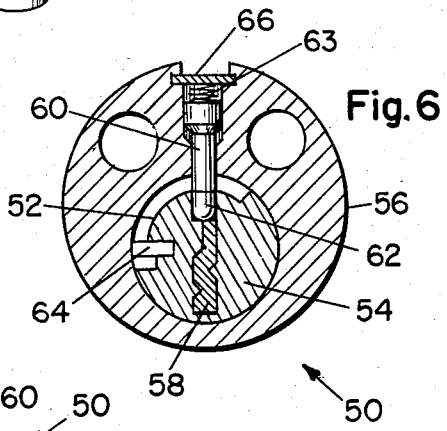
Fig. 6
Fig. 4
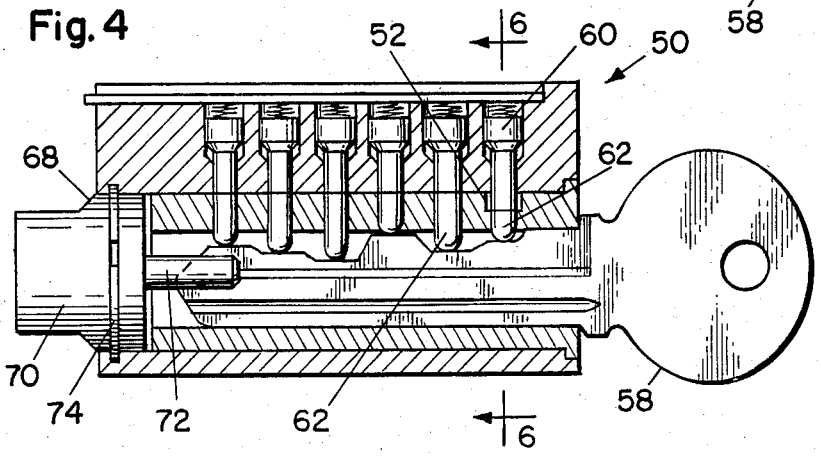

LOCK STRUCTURES

CROSS-REFERENCE TO RELATED APPLICATION

This application is a continuation-in-part of U.S. application for patent, Ser. No. 543,690, filed Oct. 20, 1983, now U.S. Pat. No. 4,590,777.

TECHNICAL FIELD

This invention relates to locks and to piston or pin type locks in particular.

BACKGROUND ART

The piston lock has wide application both as a primary locking device and as an actuator for another, primary locking apparatus. Some examples of their use as actuators in more complex structures appear in U.S. Pat. No. 4,590,777.

Piston locks, also called pin locks, are often packaged in barrel form. A cylindrical rotor is disposed in a cylindrical cavity in a larger diameter housing cylinder. The axis of the larger cylinder and its cavity are parallel but usually are spaced. One or more pairs of pistons are contained in a like number of aligned bores which extend normal to the housing and rotor axis and into both housing and rotor. Insertion of a proper key into a key slot of the rotor forces the pin to positions in which the parting plane of the pins of a pair occurs at the plane between the housing and rotor. In that condition the rotor is free to rotate in the housing and accomplish its locking and unlocking function. The pins of the housing are spring biased in the direction of the key slot. In past designs they have been free to fall out or spring out on removal of the rotor from the housing. Ordinarily that is not a problem. The cylinder need be removed from the housing only for servicing and to "change the lock" by interchanging or replacing pins to require a different key. However when it is a problem it can be a difficult one. It is not uncommon even for locksmiths to lose control of the pins and springs and once loose it takes skill and perseverence to replace them.

SUMMARY OF THE INVENTION

One object of the invention is to provide improved piston locks.

Another object is to provide a piston lock structure in which the pistons or pin and springs will not fall or spring from their bores on disassembly of the lock rotor from the lock housing.

A further object is to provide a novel arrangement for retaining the rotor in its housing when the key is inserted and the pins are in their unlocked position.

Another object is to provide the novel pin and rotor retention arrangement in a form which is applicable to padlocks and other types as well as to barrel locks.

These and other objects and advantages of the invention are realized in part by the provision of pins and pin bores having stepped diameters or other dimensional arrangements such that the springs and pins cannot fall or spring out of their bores on removal of the rotor from the housing and by provision of a multilevel or multidiameter rotor, or rotor cavity, to serve as a stop by which one or more pins may be used unless otherwise defeated to prevent disassembly of the rotor and housing when the lock is open.

BRIEF DESCRIPTION OF THE DRAWINGS

In the drawings:

FIG. 1 is a view in central cross section of a barrel lock in which the invention is embodied;

FIG. 2 is an enlarged isometric view of one of the pistons employed in the lock of FIG. 1;

FIG. 3 is an enlarged fragment of what is shown in FIG. 1;

FIG. 4 is a cross section view of an alternative form of barrel lock;

FIG. 5 is an isometric view of the rotor of the lock of FIG. 4;

FIG. 6 is a cross sectional view taken on line 6—6 of FIG. 4;

DESCRIPTION OF PREFERRED EMBODIMENT

Figure 8:
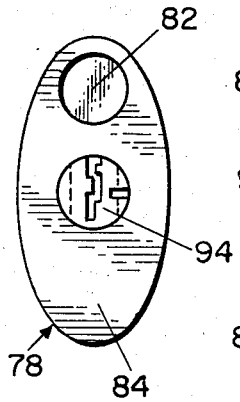
FIG. 8 is a bottom view of the padlock of FIG. 7.

A piston lock is one in which two elements having opposing surfaces touching, or in close proximity, are each formed with a number of bores which open to its surface. Each bore contains a piston or pin which is free to reciprocate in the bore. The bores of one member are aligned with the bores of the other in the closed condition of the lock such that the pins of one extend partly into the bores of the other. Some of the pins being disposed partly in one member and partly in the other, the two members are foreclosed from relative movement in either of the two dimensions in which displacement of one would move the bores out of alignment. If the pins are moved to positions in the bore such that the interface between the pins of one member with the pins of the other member lies between the opposing surfaces or at least such that no portion of a pin of one element lies within a bore of the other element, relative movement in one or both of those two dimensions is possible. In practice such relative movement is limited to one dimension and displacement in that dimension is defined as being unlocked.

A common form of such a lock is shown in FIG. 1 and in FIG. 4. They are often called barrel locks. A relatively large diameter cylinder called a housing is formed with a through bore on an axis parallel to but spaced from the axis of the housing. Another cylinder called a rotor is disposed in the bore of the housing, its axis substantially coincident with the axis of the bore. The outer diameter of the rotor is almost equal, in preferred form, to the inside diameter of the housing at the bore. A key inserted in a slot in the rotor lifts rotor pins to force the ends of housing pins to the surface of the rotor. The rotor is then free to rotate about its axis in the housing. The rotor is fixed or coupled to some kind of keeper and latch arrangement which is locked and unlocked by such rotation of the rotor. To prevent longitudinal separation of the rotor and housing they are formed with some kind of retaining means.

In practice the pins of the housing are biased toward and into the bores of the rotor by a resilient element. It is almost universal to use coiled springs to apply the biasing force. The key forces the rotor pins to "lift" the housing pins against the springs. The elements that oppose longitudinal separtion of the rotor and housing when the pins are in unlocked condition are less standard. It is preferred that they be internal because in many applications making them inaccessible enhances security.

One advantage of the piston lock is that the lock can be "changed" to require a different key. The pins of the rotor differ from one another in length. The key is made so that the width of the key and the length of the rotor pins is such that each pin is forced to the unlocked condition when the key is in place. To render one key inoperative it is required only to replace with pins of different length by substitution or interchange. To do that requires separation of the rotor and housing by moving the pins to unlocked position and by removing or disabling the means by which the rotor is ordinarily retained in the housing. If the springs and pins are permitted to fall out of their bores replacement is almost always a difficult task. In general the task is sufficiently difficult to require a locksmith and special tools. The design of the pin, bias spring and pin bores is such as to make them inaccessible to those who would attempt to violate the lock. In the case of relatively inexpensive locks it is often preferred to replace rather than to try to reassemble the device.

It is the spring biased pins of the housing that are more difficult to retain. Gravity may be utilized to keep the pins of the rotor in place in their respective bores but the bias springs necessarily exert more than gravitational force on the housing pins so gravity is not helpful in retaining springs and housing pins. In the lock 10 of FIG. 1 the pins of the housing 12 cannot fall out on removal of the rotor 14 because both those pins and the bores in which they are lodged have increased diameter at their upper ends away from the cavity in which the rotor is disposed. Pin or piston 16 is shown enlarged in FIGS. 2 and 3. Its upper portion 18 has a larger diameter than does the lower portion 20. The upper portion of the bore 22 in which the pin is contained has a diameter only slightly larger than the upper portion of the pin and the lower portion of the bore has a diameter only slightly larger than the lower part 20 of the pin. Bore 22 and the other bores of housing 12 extend through the upper part of the housing from an outer opening at the top 24 of the housing to an inner opening into the cylindrical bore in which the rotor is contained.

There are seven housing pins in respectively associated ones of seven housing pin bores in this design. All seven bores are closed near their upper ends by a common retainer strip 26 which is inserted in a longitudinal slot 28 best shown in FIG. 2. A bias spring is trapped between the strip 26 and the housing pin in each of the seven bores. The spring in bore 22 is numbered 30. The bias springs urge their respective housing pins downwardly and in each case the lower, smaller diameter end of the housing pin is longer than the lower, smaller diameter portion of the bore in which it is disposed. In locked condition the bores of the rotor are aligned with those of the housing. In the absence of the key 32 the housing pins extend down into respectively associated bores in the rotor.

Each of the rotor bores contains a rotor pin which is lifted upon the insertion of a key that "fits" the lock. The sum of the width of the key at the point of engagement with any pin and the length of that pin is enough to raise the associated housing pin to clear the rotor but not enough to permit entry of the rotor pin into the housing. In FIG. 1 the rotor pin 34 has been lifted just enough by key 32 so that the juncture of pins 16 and 34 occurs at the plane of separation of the rotor 14 and the housing 12. All of the pins are arranged in FIG. 1 so that no rotor pin extends into the housing and so that no housing pin extends into the rotor. The rotor is free to rotate in the housing and the key serves as the lever or handle for applying the rotational force. In an actual application rotation of the rotor is made to actuate another mechanism that results in a locking or unlocking action.

A C-ring or spring 36 is disposed in an annular groove formed in the outer wall of the rotor. It extends beyond the rotor wall behind the housing so the rotor cannot be withdrawn from the housing to the right. In some circumstances it is not acceptable that the means for preventing separation of the rotor from the housing be so easily accessible. Also, in some cases a means is required for preventing removal of the rotor from either the front or the rear of the housing. The task is then to make that means inaccessible while providing a convenient means for removal of the rotor without loss of the pins when it is desired to "change" the lock. That has been done in the embodiment shown in FIGS. 4, 5 and 6.

Instead of a C-spring like spring 36, one of the pins is used to retain the rotor in the housing. Operation of the lock by rotation of the rotor in the housing requires only that the separation between rotor and housing pins occur in the plane or space which separates the rotor and housing. Axial separation of the rotor from the housing requires only that no part of the rotor be larger in diameter than the cylindrical cavity of the housing in the direction in which the rotor is to be removed. Those conditions are met in a uniform diameter design such as the one depicted in FIG. 1. They can also be met in a design in which the diameters of one or both rotor and cavity are stepped or tapered. They can also be met in a design in which the diameter of the rotor is decreased, or the diameter of the cavity is decreased over part of its length. That has been done in the lock 50 of FIGS. 4, 5 and 6. A circumferentially directed groove 52 has been milled in the surface of the rotor 54.

The rotor 54 is disposed in a cylindrical cavity in the housing 56. The key 58 is in the lock and it has lifted the six rotor pistons or pins such that those pins have lifted the housing pins against the bias of their respective bias springs. In the case of each pair of rotor and housing pins the parting line between pins is such that the rotor pin does not extend into the bore of the housing and the housing pin does not extend into the rotor bore. In the case of five of the pairs that parting line occurs at the surface of the housing cavity but in the first pin pair from the right in FIG. 4 the housing pin 60 extends down into the rotor groove 52. It bears against the rotor pin 62 at the level of the bottom of groove 52. That can also be seen in FIG. 6. Spring 63 is trapped between the retainer strip 66 and the pin 60. In the absence of key 58 the spring would force the pin 60 down so its lower end was lodged in the bore of the rotor. The rotor pin would be drawn down by gravity or be forced away by pin 60. Thus in the absence of a proper key pin 60 would contribute to locking like any of the other housing pins. In the locking and unlocking functions it is like any any other pin except, as will be apparent on inspection of FIG. 6, it serves to limit rotation of the rotor to the arc over which groove 52 extends. If it is desirable in a given application that rotation be limited to a different angular degree the arc would be made to extend to that degree. If the groove extended entirely around the rotor the rotor could be rotated completely around. However, even in unlocked condition the pin 60 is in the groove 52. It retains the rotor against axial displacement in the housing. Unlike the C-spring 36 of FIG. 1 it is not accessible at the exterior of the unit.

Figure 9:
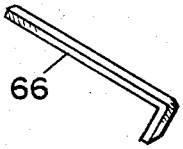
FIG. 9 is an isometric view of an L-shaped tool which is representative of tools useful in the invention.

Before the rotor can be removed from the housing for servicing or lock change, the pin 60 must be lifted to clear groove 52. To that end another groove is formed in the surface of the rotor as best shown in FIG. 5. Groove 64 extends longitudinally from the front end of the rotor at least to the groove 52. It could extend from the rear instead or could extend the full length of the rotor. All that is required is an arrangement for lifting the pin with some kind of tool, such as the small Allen wrench 66 shown in FIG. 9. The groove 64 must intersect with the groove 52 and, of course, it must not intersect the bores in which the rotor pins are contained. Only when the lock has been opened can the rotor be rotated to align the groove 64 with pin 60 and only then can the pin be lifted by a tool which is inserted in groove 64.

The tapered flat 68 at the rear of the rotor serves as a cam to facilitate reinsertion of the rotor into the housing. It aids by lifting the housing pins during insertion. Also, it will be apparent that the groove 52 may be positioned and sized to cooperate with any other pair of pins or with more than one pin pair. In this design the flat 68 is formed on a separate locking element 70 which is connected by two pins to the end of the rotor 54. The pins extend parallel to the rotor axis into bores in the rotor one on each side of the key slot. One pin 72 is visible in FIG. 4. Element 70 is rotatable with the rotor but is not removable with it. It is retained by a retainer spring 74 which is disposed in matching grooves in the outer wall of the element and the inner wall of body 56.

Figure 7:
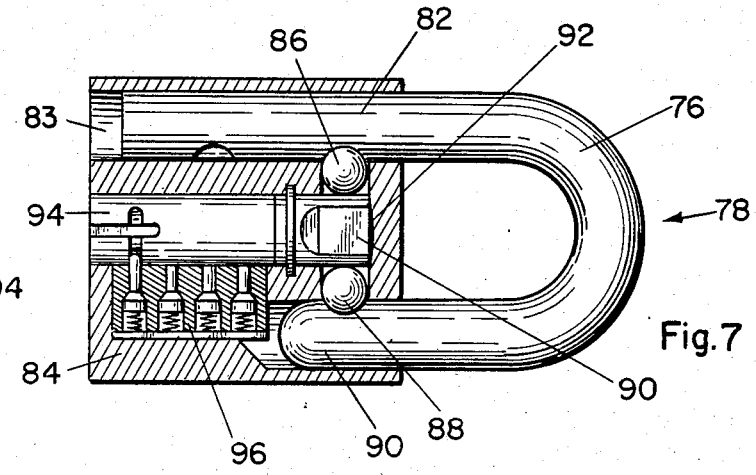
FIG. 7 is a cross sectional view of a padlock in which the invention is embodied.

FIGS. 7 and 8 illustrate how the invention can be applied to a padlock. The bail 76 of the padlock 78 is J-shaped. The longer arm 82 is slideably and rotatably disposed in bore 83 of padlock 84. The bail is retained in the locked closed condition by two metal balls 86 and 88 which fit into respectively associated depressions in arms 82 and 90 of the bail. The balls are held in those depressions to prevent withdrawal of the bail by a cam 90 at the upper end of a locking element 92 which is almost a duplicate of element 70 of FIGS. 4 and 5 and which rotates with rotor 94. The cam is formed by milling flats on opposite sides of the end of the element. When the rotor is rotated 90 degrees the balls are free to move inwardly against the flats to release the bail. That part of the construction is conventional. The rotor is like the rotor 54 of FIG. 5 except that instead of being six pins long it is only four pins long in this embodiment. Pins and springs and a retainer strip like those that are disposed in bores and slots in the housing of FIGS. 4 and 6, are part of a separate assembly 96 in the padlock. The assembly is disposed as a unit in a recess milled out of the body of the lock.

In obedience to the rules, the best mode now known for practicing the invention has been shown in the accompanying drawing and described in the specification above. However, it is to be understood that other embodiments and variations of the invention are possible and that the invention is to be limited by what is defined in the appended claims rather than by what has been shown.

I claim:

1. A lock comprising in combination:

a housing formed with a cylindrical cavity;

a cylindrical rotor disposed for rotation in said cavity, its axis substantially coincident with the axis of the cavity;

a plurality of bores formed in said housing each opening to said cavity;

a like plurality of housing pins each disposed in a respectively associated one of the bores of the housing;

a plurality of rotor bores formed in said rotor; the bores of the rotor being axially aligned with respectfully associated ones of the bores of the housing in one relative position of the rotor and housing and the pins having a size to fit into the bores of the rotor;

the surface of the rotor being formed with a groove into which at least one, but less than all, of the bores of the rotor opens, the groove extending in an arc over a portion, at least, of the circumference of the rotor;

biasing means for urging the housing pins to extend into the bores of the rotor; and means for forcing said housing pins against the urging of said biasing means to a position in which they are adjacent to, but not in, respectively associated ones of said bores of the rotor whereby said rotor is free to rotate in said housing through said arc and is precluded from removal axially from said housing in which said housing bores and said housing pins are stepped to larger cross-sectional area at a point along their length away from said cavity; and which further comprises a second groove formed in the rotor parallel with the axis of the rotor such that it intersects said first mentioned groove but does not intersect said rotor bores.

* * * * *